US006634569B2

(12) United States Patent
Boecking

(10) Patent No.: US 6,634,569 B2
(45) Date of Patent: Oct. 21, 2003

(54) PRESSURE-CONTROLLED INJECTOR FOR INJECTING FUEL

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 160 days.

(21) Appl. No.: 09/893,404

(22) Filed: Jun. 29, 2001

(65) Prior Publication Data

US 2002/0043569 A1 Apr. 18, 2002

(30) Foreign Application Priority Data

Jun. 29, 2000 (DE) ..... 100 31 576

(51) Int. Cl.[7] ..... F02M 47/02
(52) U.S. Cl. ..... 239/88; 239/92; 239/96
(58) Field of Search ..... 239/88, 89.96

(56) References Cited

U.S. PATENT DOCUMENTS 5,485,957 A * 1/1996 Sturman ..... 239/88

* cited by examiner

*Primary Examiner*—Lisa A. Douglas
(74) *Attorney, Agent, or Firm*—Ronald E. Greigg

(57) ABSTRACT

An injector for injecting fuel into the combustion chambers of an internal combustion engine in which a movable control part is contained in the housing of the injector and is guided in this injector housing to unblock the inlet to an injection nozzle when a closing element relieves the pressure in a control chamber or closes the inlet when a pressure is built up in the control chamber. The nozzle needle of the injector is associated with a piston element which encourages the closing movement of the nozzle needle and counteracts its opening movement.

12 Claims, 1 Drawing Sheet

PRESSURE-CONTROLLED INJECTOR FOR INJECTING FUEL

BACKGROUND OF THE INVENTION

1. Field of the Invention

In injectors for injecting fuel into the combustion chambers of internal combustion engines, very high fuel pressures occur. On the one hand, the injectors for injecting the fuel are embodied with the necessary fatigue strength; on the other hand, however, the attempt should be made wherever possible to relieve the components of such an injector, for example the nozzle needles, from the high pressures that occur in order to reduce the mechanical strain.

2. Description of the Prior Art

DE 198 35 494 A1 relates to a pump/nozzle unit for feeding fuel into a combustion chamber of directly injected internal combustion engines. A pump unit is provided for building up an injection nozzle. Furthermore, a control unit with a control valve is provided, which is embodied as an A-valve opening outward, as well as a valve actuation unit for controlling the build-up of pressure in the pump unit. The valve actuation unit is embodied as a piezoelectric actuator for the purpose of achieving short response times of the pump/nozzle unit.

DE 37 28 817 C2 relates to a fuel injection pump for an internal combustion engine.

The control valve member is comprised of a valve shaft, which forms a guide sleeve and slides in a channel, and a valve head, which is connected thereto, is oriented toward the actuation device, and whose sealing surface cooperates with the surface of the control bore forming the valve seat. On its circumference, the valve shaft has a recess whose axial span extends from the mouth of the fuel supply line to the beginning of the sealing surface on the valve head that cooperates with the valve seat. In the recess, a surface is formed which is subjected to the pressure of the fuel supply line and is the same size as a surface of the valve head that is subjected to the pressure of the fuel supply line when the control valve is closed. In this manner, the valve is pressure balanced when it is closed. Furthermore, the guide sleeve contains a spring which loads the control valve in the direction of its open position.

In the currently used injector designs for high-pressure accumulation chamber applications (common rail), the injection nozzle is relieved of pressure for the closing process. A 3/2 seat-slide valve is used for this purpose. During the closing phase of the valve, the fact that the high-pressure inlet is still open can coincide with the fact that the leakage oil outlet has already opened. By virtue of a delayed pressure relief on the nozzle needle, the pressure does not decrease rapidly enough and the closing phase is delayed. The short circuit between the common rail inlet and the leakage oil outlet occurring during the closing phase decreases the efficiency of the injector considerably.

SUMMARY OF THE INVENTION

With the injector for injecting fuel into the combustion chambers of directly injected internal combustion engines, which is proposed according to the invention, the closing phase of the injector control part, which can move in the injector housing, can be used to increase the pressure against the nozzle needle so as to achieve a pressure build-up there which encourages the closing movement. For this purpose, a compression spring is admitted in a hollow chamber provided below the leakage oil slide valve and a piston element is mounted in a movable manner. During the closing phase, the overflowing fuel from the high-pressure accumulation chamber can act on an end face of the piston element provided below the leakage oil slide valve. As a result, this piston element acts on a compression spring element, which rests against a plate surface of the nozzle needle.

The pressure build-up in the piston element only occurs when, through actuation of the control part, its closing edge on the high-pressure side is inserted into a seat face in the housing of the injector and closes the inlet, which branches off from the valve chamber and leads to the nozzle chamber.

The connection of the valve chamber, into which the common rail inlet empties, to the outlet-side leakage oil chamber, which occurs for a brief time during the closing phase, can be enlisted in order to use the high pressure, which prevails for a brief time by way of the high-pressure inlet, to produce a closing motion of the nozzle needle in order to reduce its closing time. In this manner, the volume of the overflowing fuel caused by short circuit that briefly occurs can be kept within limits, which permits improvement of the overall efficiency of the injector proposed according to the invention. Moreover, the fuel injection quantity to be measured can be metered with considerably greater accuracy because closing times as well as opening pressures can now be determined with significantly greater precision.

In the reverse case of the opening of the nozzle needle, by providing the piston element, which is associated with the nozzle needle, an opening of the nozzle needle can only be performed in the case of a higher opening pressure. Only after an opening pressure has been achieved in the nozzle chamber, which exceeds the forces acting on the nozzle needle by way of the piston element and/or the sealing spring, does an opening of the injection nozzle occur. Thus, the injection process that can be achieved using the embodiment proposed according to the invention is substantially more precise because the build-up of injection pressure can initially wait until the injection of the injection quantity into the combustion chamber of the internal combustion engine occurs.

BRIEF DESCRIPTION OF THE DRAWINGS

The invention will be explained in greater detail below in conjunction with the drawings, in which.

DESCRIPTION OF THE PREFERRED EMBODIMENTS

Figure 1:
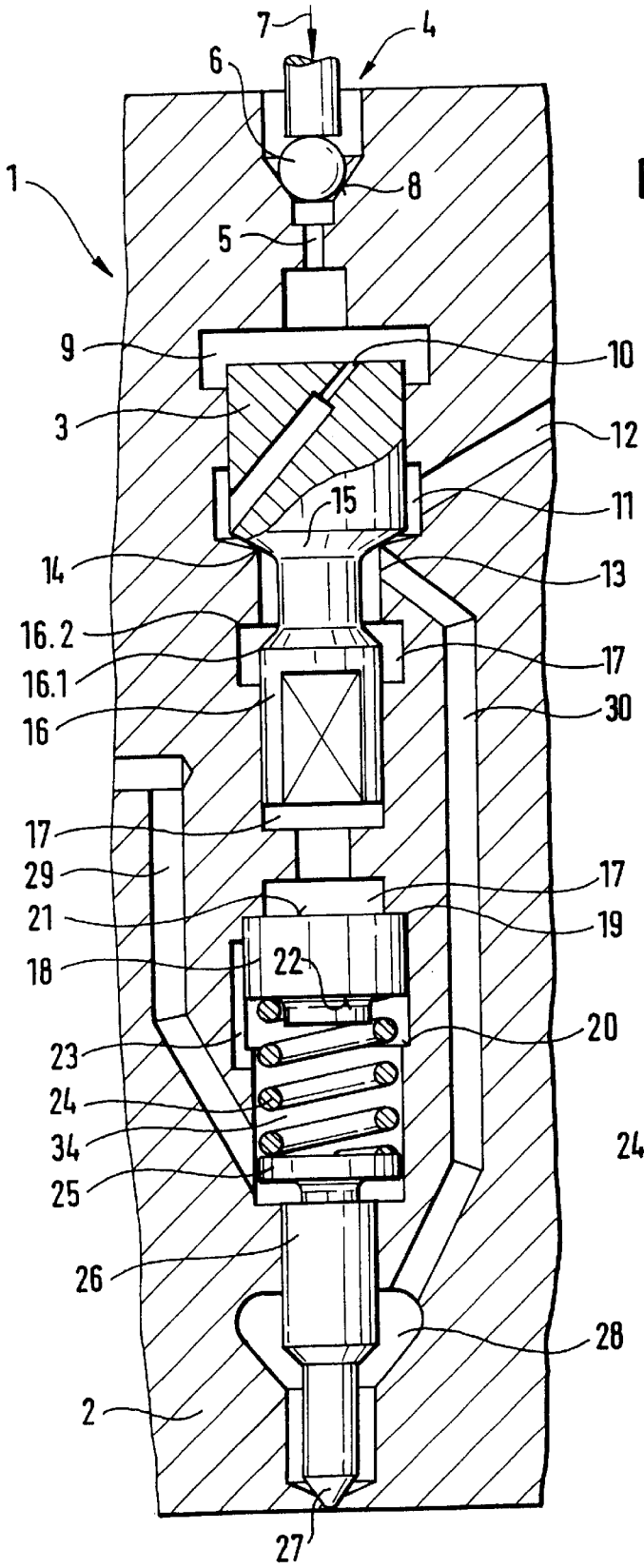
FIG. 1 is a longitudinal section through an injector for injecting fuel, with a piston element associated with the nozzle needle.

FIG. 1 shows a longitudinal section through an injector for injecting fuel, with a piston element associated with the nozzle needle, whose outlet-side leakage oil opening can be embodied as a longitudinal groove in the housing of the injector.

The injector 1 proposed according to the invention includes a housing 2 in which a control part 3 is contained in a movable fashion. The control part 3 is guided in the injector housing 2 with its region that is embodied with an enlarged diameter. The upper portion of the control part 3 has an end face embodied on it, which protrudes into a control chamber 9.

Above the control chamber 9, there is a control element 4, which can be embodied as a piezoelectric actuator, an electromagnet, or a mechanical/hydraulic translator, which is not shown in detail in the depiction according to FIG. 1. A closing element 6, for example embodied in a spherical shape, is pressed into its sealing seat 8 in the actuator working direction 7, thus closes the outlet throttle 5 of the control chamber and constantly applies pressure to the control volume continuously flowing into the control chamber by way of the inlet throttle 10 embodied in the control part 3. Only when the actuator, which is not shown here, is actuated does a pressure relief in the control chamber 9 occur. As a result, the upper end face of the control part 3, into which the inlet throttle 10 empties, moves into the control chamber 9.

Encompassing the control part 3 in its widened head region, a valve chamber 11 is provided in the injector housing 2, into which chamber the inlet 12 from the high-pressure accumulation chamber (common rail) empties. The valve chamber 11 is defined by the valve housing 2 and sealed by the sealing edge 14 on the circumference of the control part 3, which presses into its sealing seat by means of the high pressure prevailing in the control chamber 9, which corresponds to the pressure in the high-pressure accumulation chamber. Thus, the branch 13 to the nozzle inlet 30 remains closed, so that the nozzle chamber 28 encompassing the nozzle needle 26 is not acted on by highly pressurized fuel.

Below the head region of the control part 3, which region is embodied with an enlarged diameter, a constriction point is embodied thereon, to which a leakage oil slide valve 16 is connected. The leakage oil slide valve 16 is partially encompassed by an annular leakage oil chamber in the housing 2 of the injector 1. On its upper edge, the leakage oil chamber has a control edge 16.2 that cooperates with the control edge 16.1 embodied on the control part 3 during the upward motion of the control part 3, upon the pressure relief of the control chamber 9, through actuation of the actuating element 4. By moving the control edges 16.1 on the leakage oil slide valve 16 and 16.2 in the housing 2 of the injector 1 into an overlapping position, the leakage oil chamber 17 is sealed off to the greatest possible extent from the high pressure prevailing by way of the inlet 12 from the common rail.

The leakage oil slide valve 16 extends with its lower end face into an extension of the leakage oil chamber 17, below which a piston element 18 is provided in the injector housing 2 and can be moved between two stops 19 and 20. The piston element 18 has an upper end face 21 as well as a lower end face 22. A pin-like extension is associated with the lower end face 22, with which the piston element 18 is admitted into the coils of a spring element 24 that is, for example, is embodied as a helical spring. The spring element is enclosed by a hollow chamber 34 in the injector housing 2 and is supported at one end against the lower end face 22 of the piston element 18 and at on the other end, is supported against a spring plate 25 embodied on the nozzle needle 26. Below the spring plate 25 on the nozzle needle 26, the nozzle needle 26 extends through the nozzle chamber 28 encompassing it, to the nozzle tip 27.

The nozzle chamber 28, which encompasses the nozzle needle 26, can be acted on by highly pressurized fuel by way of a nozzle inlet 30, where the nozzle inlet 30 at the branch is connected to the inlet 12 from the high-pressure accumulation chamber upon the vertically upward movement of the control part 3 and fuel can travel into the nozzle chamber 28 by way of the branch 13 and the nozzle inlet 30. The hollow chamber 34 containing the spring element 24 in the housing 2 of the injector 1 also has a leakage oil line connection 29, from which excess fuel can be conveyed back into the fuel reservoir of the motor vehicle, for example, in a pressure-free manner. According to the depiction in FIG. 1, the hollow chamber 34 in the housing 2 of the injector 1 is connected to the upper part of the leakage oil chamber 17 by way of a leakage oil groove 23, so that leakage oil can flow from this chamber into the lower hollow chamber 34 and, from there, can be discharged by way of the leakage oil line 29.

Figure 2:
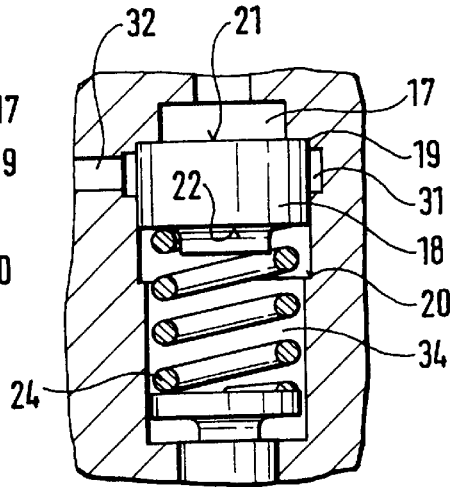
FIG. 2 shows a detail of the leakage oil discharge line provided on the outlet side.

An alternative embodiment of the leakage oil discharge line from the leakage oil chamber 17 and the hollow chamber 34 in the housing 2 of the injector 1 can be seen in the depiction according to FIG. 2.

The piston element 18, with its upper end face 21 and its lower end face 22, can be moved between a first stop 19 and a second stop 20 in the housing 2 of the injector 1 and is encompassed by a recess 31 extending in the shape of a ring. A leakage oil bore 32 branches off laterally from this recess 31 and feeds into the leakage oil discharge line 29, as is already shown in FIG. 1. The leakage oil chamber embodied below the control slide valve 16 is disposed above the upper end face 21 of the piston element 18; the hollow chamber 34 of the housing 2 of the injector 1 is shown below the piston element 18 and can contain the spring element 24, which is embodied as a helical spring, for example.

The piston element 18 according to the invention, which can move between two stops 19 and 20 in the housing 2 of the injector 1, functions as follows:

When the control element 4 is actuated by means of an actuator that is not shown here, the control chamber 9 in the housing 2 of the injector 1 is relieved by way of the outlet throttle 5, the control part 3 travels into the control chamber 9 with its end face. As a result, the fuel emerging from the inlet 12 under high pressure flows from the high-pressure accumulation chamber (common rail) into the valve chamber 11 in the housing 2 of the injector 1 and travels by way of the branch 13 into the nozzle inlet 30 and from there, flows into the nozzle chamber 28, from whence it is injected into the combustion chamber of an internal combustion engine by way of the nozzle tip 27. While the control part 3 is being raised, highly pressurized fuel also travels into the leakage oil chamber 17 by way of the control edges 16.1 and 16.2, disposed on the leakage oil slide valve 16 and in the housing 2 of the injector 1 respectively, which have not yet been moved completely past one another. Therefore, a higher pressure prevails against the upper end face 21 of the piston element 18. If further pressure is now continuously built up in the valve chamber 11, the higher pressure also prevails in the nozzle chamber 28 so that when a certain predetermined opening pressure is achieved, which depends on the dimensions, the nozzle needle 26 is opened counter to the pressure prevailing in the leakage oil chambers 17 and 34 and counter to the compression spring 24 acting on the spring plate 25. In this case, the piston element 18 acts as a delaying member during the opening of the injection nozzle 27 because the nozzle only opens and injects fuel into the combustion chamber of an internal combustion engine when a certain opening pressure has been achieved. It is thus possible on the one hand, to set the injection time in a substantially more precise fashion; furthermore, the injection quantity of fuel to be metered can be measured more precisely because it is ensured that, when the injection nozzle 27 opens, the pressure necessary for the exact metering of the injection quantity prevails in the nozzle chamber 28.

Conversely, when the control part 3 closes, i.e. when the sealing edge 14 is inserted into the sealing seat 15, a brief coincidence occurs between the still-open inlet 12 of the high-pressure accumulation chamber and the control edges 16.1 and 16.2, which are not yet completely overlapping, between the leakage oil slide valve 16 and the housing 2 of the injector 1. The nozzle needle 26 is now relieved by way of the pressure chamber 28 as well as the nozzle chamber 20 into the leakage oil chamber 17, whereupon the level of pressure still present is used to build up a pressure, by way of the leakage oil chamber 17, against the upper end face 21 of the piston element 18, which moves the piston element 18 from the first stop 19 to the second stop 20. This compresses the compression spring provided in the hollow chamber 34 in the housing 2 of the injector 1, which spring in turn presses the nozzle needle 26, by way of the spring plate 25, into its sealing seat at the nozzle tip 27. Consequently, the pressure level still prevailing in the housing 2 of the injector 1 can be used to accelerate the closing motion of the nozzle needle 26 into its closing position so that the closing time, i.e., the pressure relief of the nozzle needle 26 can occur in a significantly more rapid fashion. On the other hand, the piston element provided according to the invention, which is disposed in the housing 2 of the injector 1, permits a delayed opening of the nozzle tip 27 from its seat until an opening pressure level required for injecting the correctly metered fuel quantity is attained in the nozzle chamber 28.

The foregoing relates to preferred exemplary embodiment of the invention, it being understood that other variants and embodiments thereof are possible within the spirit and scope of the invention, the latter being defined by the appended claims.

I claim:

1. An injector for injecting fuel into the combustion chambers of an internal combustion engine, comprising an injector housing (2) containing a movable control part (3) having a slide valve (16), which is supported in the housing (2) and unblocks an inlet (13) to an injection nozzle (27) when the pressure of a control chamber (9) is relieved by means of a control element (4) or closes said inlet (13) when there is pressure built-up in the control chamber (9), wherein a nozzle needle (26) is associated with a piston element (18), having an upper end face (21), which encourages its closing movement and resists its opening movement, said upper end face (21) being arranged within a leakage oil chamber (17), being connectable, via said slide valve (16) with an inlet (12) and a bore (30) from nozzle chamber (28).

2. The injector according to claim 1, wherein said piston element (18) can move between two stops (19, 20) in the housing (2) of the injector (1).

3. The injector according to claim 1, further comprising a spring element (24) admitted between the nozzle needle (26) and a lower end face (22) of the piston element (18).

4. The injector according to claim 1, wherein an upper end face (21) of the piston element (18) can be acted on byway of the leakage oil chamber (17) with fuel emitting from the inlet (12) of the high-pressure accumulation chamber.

5. The injector according to claim 1, wherein during the closing of the control part (3) against a sealing seat (14,15), highly pressurized fuel in the already-open leakage oil slide valve (16) flows into the leakage oil chamber (17) and acts on the upper end face (21) of the piston element (18) and encourages its movement toward the second stop (20).

6. The injector according to claim 1, wherein during the opening phase of the control part (3), highly pressurized fuel acts on the valve chamber (11), the leakage oil chamber (17), and the upper end face (21) of the piston element (18) acting as a delaying member, and an opening of the nozzle needle (26) occurs only after an opening pressure has built up in the nozzle chamber (28).

7. The injector according to claim 1, further comprising a longitudinal groove (23) for overflow of leakage oil in the housing (2) of the injector (1) is embodied on the outlet side, between the leakage oil chamber (17) and the hollow chamber (34).

8. The injector according to claim 1, wherein in the housing (2) of the injector (1), a recess (31) encompassing the piston element (18) is formed, which has a leakage oil bore (32) branching off from it.

9. The injector according to claim 7, further comprising a leakage oil line (29) which branches off from the hollow chamber (34) below the piston element (18).

10. The injector according to claim 3, where on its lower end face (22), the piston element (18) has an extension in the form of a pin that protrudes into the spring element (24).

11. The injector according to claim 2, wherein during the closing of the control part (3) against a sealing seat (14,15), highly pressurized fuel in the already-open leakage oil slide valve (16) flows into the leakage oil chamber (17) and acts on the upper end face (21) of the piston element (18) and encourages its movement toward the second stop (20).

12. The injector according to claim 2, wherein during the opening phase of the control part (3), highly pressurized fuel acts on the valve chamber (11), the leakage oil chamber (17), and the upper end face (21) of the piston element (18) acting as a delaying member, and an opening of the nozzle needle (26) occurs only after an opening pressure has built up in the nozzle chamber (28).

* * * * *